US010195660B2

(12) United States Patent
Gartner et al.

(10) Patent No.: US 10,195,660 B2
(45) Date of Patent: Feb. 5, 2019

(54) CASTING DEVICE AND CASTING METHOD

(71) Applicant: Mubea Performance Wheels GmbH, Salzburg (AT)

(72) Inventors: Josef Gartner, Mining (AT); Werner Hubauer, Tumeltsham (AT)

(73) Assignee: Mubea Performance Wheels GmbH, Salzburg (AT)

( * ) Notice: Subject to any disclaimer, the term of this patent is extended or adjusted under 35 U.S.C. 154(b) by 0 days.

(21) Appl. No.: 15/830,615

(22) Filed: Dec. 4, 2017

(65) Prior Publication Data

US 2018/0154432 A1 Jun. 7, 2018

(30) Foreign Application Priority Data

Dec. 5, 2016 (EP) ..... 16202301

(51) Int. Cl.
*B22C 9/22* (2006.01)
*B22D 18/04* (2006.01)
(Continued)

(52) U.S. Cl.
CPC ..... *B22D 17/2236* (2013.01); *B22C 9/22* (2013.01); *B22D 15/005* (2013.01); *B22D 17/32* (2013.01);
(Continued)

(58) Field of Classification Search
CPC ..... B22C 9/22; B22D 15/005; B22D 18/04; B22D 25/02; B22D 27/11
See application file for complete search history.

(56) References Cited

U.S. PATENT DOCUMENTS 4,840,557 A * 6/1989 Ishimoto ..... B22D 17/12 164/312
5,900,080 A * 5/1999 Baldi ..... B21J 5/004 148/549
(Continued)

FOREIGN PATENT DOCUMENTS

CN 201760581 U 3/2011
DE 19815418 A1 10/1999
(Continued)

OTHER PUBLICATIONS

European Search Report for EP16202301.4 dated May 29, 2017 (with English translation; 10 pages).

*Primary Examiner* — Kevin E Yoon
(74) *Attorney, Agent, or Firm* — Bejin Bieneman PLC

(57) ABSTRACT

A device for casting a metallic component comprising an outer undercut comprises a base body with a first end portion and a circumferential side wall comprising a tapering inner surface; a first die part that is insertable into the base body and that forms a first molding surface for the component to be cast; a plurality of side die parts, which are insertable into the base body and which, in the inserted state, are radially supported against the circumferential side wall of the base body and form a die ring comprising an inner molding surface for the component to be cast; a second die part which is moveable into the die ring formed by the side die parts to a casting position, and which forms a second molding surface for the component to be cast, wherein in the casting position, the second die part is arranged in a completely contact-free manner with respect to the first die part.

15 Claims, 4 Drawing Sheets

(51) Int. Cl.

| | |
|---|---|
| ***B22D 25/02*** | (2006.01) |
| ***B22D 27/11*** | (2006.01) |
| ***B22D 17/22*** | (2006.01) |
| ***B22D 15/00*** | (2006.01) |
| ***B22D 17/32*** | (2006.01) |

(52) U.S. Cl.
CPC ..... *B22D 18/04* (2013.01); *B22D 25/02* (2013.01); *B22D 27/11* (2013.01)

(56) References Cited

U.S. PATENT DOCUMENTS

| | | | | |
|---|---|---|---|---|
| 2004/0177942 | A1* | 9/2004 | Mason | B22D 15/005 164/71.1 |
| 2004/0194906 | A1* | 10/2004 | Baumgartner | B22C 9/088 164/135 |

FOREIGN PATENT DOCUMENTS

| | | | | |
|---|---|---|---|---|
| DE | 10234026 | C1 | 11/2003 | |
| DE | 102006025830 | A1 * | 12/2007 | B22D 15/005 |
| DE | 10 2009 051 879 | B3 | 6/2011 | |
| EP | 0423447 | A2 | 4/1991 | |
| EP | 2848333 | A1 | 3/2015 | |
| FR | 2224229 | A1 | 10/1974 | |

* cited by examiner

CASTING DEVICE AND CASTING METHOD

CROSS-REFERENCE TO RELATED APPLICATIONS

This application claims priority to, European Patent Application No. EP 16202301.4, filed on Dec. 5, 2016, which application is hereby incorporated herein by reference in its entirety.

BACKGROUND

Efforts in the direction of lightweight construction and passenger protection lead to the increased development of high-strength and ultra-high-strength components, which have a lower weight than common components with at least identical strength properties. It is known to produce lightweight metal components, in particular light metal wheels for motor vehicles by casting.

A method and a device for the pressure casting of light metal wheels are known from EP 0 423 447 A2. The device comprises a stationary supported central mold part, a height-adjustable die, and two lateral half shells. The half shells have an outer conical surface, which can engage with a height-adjustable annular body comprising a conical inner surface.

A method and a device for producing a metallic component by means of a casting and forming tool are known from EP 2 848 333 A1. The method comprises the steps: casting a melt into the casting and forming tool at a first pressure, applying pressure to the solidifying melt in the tool with a larger second pressure, and compressing the component, which solidified from the melt, in the tool with a larger third pressure.

A method for producing a metal die-cast part is known from DE 10 2009 051 879 B3. The mold cavity is filled from below into the casting mold by means of a metal melt pump. After filing the casting mold, the intake opening is closed tightly. During the solidification process, pressure is subsequently applied to the metal melt, which is enclosed in the mold cavity.

In view of the various demands which are to be met with regard to production accuracy, wear tendency, temperature balance and high pressure suitability of the tool, if applicable, the construction of a reusable casting and forming tool, which is also called mold, represents a challenge.

A low pressure casting die for producing motor vehicle rims comprising lateral undercuts, is known from DE 102 34 026 C1. The casting die comprises a base plate comprising a central casting nozzle, a vertically movable core, as well as horizontally and vertically displaceable split mold blocks. Together with the core, the mold blocks are fixed to a bridge, and can be vertically displaced therewith. A head plate, by means of which the mold blocks can be moved apart from one another via sliding wedge pairs, is fastened to the bridge so as to be capable of being raised and lowered. The base plate has lateral wedge pairs, against which the mold blocks rest with outer wedge surfaces in the closed state. A bottom mold, with which the core is in resting contact in the closed state of the die, is supported on the base plate.

Furthermore, molds are known which have ejector pins for ejecting the cast component. Such ejector pins are subject to a high wear, in particular in the case of high casting pressures, which, in turn, can lead to a cast part distortion.

SUMMARY

The present disclosure relates to a device and a method for producing a metallic component, in particular a light metal wheel. The present disclosure includes a device for casting a metallic component, which device has a simple design, which is only subject to a small wear, and by means of which near-net-shape components can be produced with high production accuracy. A method, can be performed with little wear, by which cast components can be produced with high production accuracy.

A casting device for producing a metallic component comprises an outer undercut, the device comprising a base body with a first end portion and a circumferential side wall, wherein the side wall has an inner surface, which tapers in the direction towards the first end portion; a first die part, which is insertable into the base body and which forms a first molding surface for the component to be cast; a plurality of side die parts, which are insertable into the base body, wherein the side die parts are radially supported against the circumferential side wall of the base body in the inserted state and form a die ring comprising an inner molding surface for the component to be cast; a second die part, which is movable into the die ring formed by the side die parts to a casting position and which forms a second molding surface for the component to be cast, wherein, in the inserted state of the side die parts into the base body, the second die part is movable axially relative to the side die parts, and is arranged in a completely contact-free manner with respect to the first die part in the casting position.

An advantage of the device is that cast components comprising one or a plurality of undercuts can be produced therewith in a near-net-shape with very good strength properties and a high production accuracy in an efficient manner. Because the second die part does not have a defined stop with respect to the first die part, that is, it can be moved further in the direction towards the first die part from the end position to be set for casting (casting position), pressure can be applied to the component, which solidifies from the melt, after completely filling the mold cavity. Thus, a temperature-related shrinking of the component volume can be compensated for. The pressure application after the casting further contributes to a fine grain structure with small crystals, which ultimately leads to good strength properties of the component. Due to the stop-free configuration between first and second die part, a static overdeterminacy of the die system is avoided, which leads to good closing properties of the casting device. A heat expansion of the die parts, which appears as a result of the heat input of the melt, is advantageously compensated for by automatic axial fine-positioning of the side die parts. In the case of a larger radial heat expansion of the side die parts, the latter come to rest against the base body sooner, that is, they penetrate less deeply into the base body; in the case of a smaller radial heat expansion, in contrast, the side die parts penetrate deeper into the base body. Depending on the size and shape of the component to be cast, these positioning tolerances can be approximately 1/10 or several tenth of a millimeter, respectively, for example. In spite of heat expansion and associated positioning tolerances, the side die parts are always centered with respect to the base body and the first die part held therein, respectively.

An operating device can be provided to produce a relative movement between the second die part and the first die part. The second die part can be moved in the axial direction by means of the operating device. The second die part can in particular be moved beyond the end position in the direction towards the base body or towards the first die part, respectively, in order to apply pressure to the component to be cast. In this respect, the operating device can also be referred to as a pressure application device. The casting device and/or the die parts, which form the mold cavity, respectively, are configured accordingly to be pressure-loaded, and are suitable to apply pressures of at least one bar, in particular more than 10 bar, preferably between 10 and 1000 bar to the workpiece and to withstand those pressures, respectively. For the side die parts, one or a plurality of holding devices can be provided for holding the side die parts in the closed position in the inserted state, when pressure is introduced into the solidifying component via the pressure application device. The holding device(s) can be designed in the form of controllable power units, for example hydraulic positioning cylinders.

The first die part can be a lower die part, for example, which is held in a stationary manner on a support. In this case, the second die part can be an upper die part, which can be moved relative to the lower part. It is to be understood, however, that a reverse assignment, that is, a first die part as upper part and second die part as lower part, is possible as well. The assignment as to which of the two parts is held in a stationary manner and which of the two parts is axially movable, can be freely chosen. In the context of the present disclosure, a description in such manner that one component can be moved with respect to another component, is to always also include the kinematic reversal in this respect. The die parts are complimentary so as to make up a complete metal mold assembly and to jointly form the mold cavity to be filled with molten metal, respectively. To that extent, the die parts can also be referred to as mold parts.

All castable metals and metal alloys, respectively, can be used as material for producing the component. In particular metal alloys of light metal, such as aluminum, magnesium and/or titanium are possible for the production of wheels as cast part. Depending on the casting material, the casting device can be designed to produce components with a weight of, for example, five to 100 kilograms. The shape of the die parts adapted according to the shape of the components which are to be produced, can generally be variable. The casting device is particularly suitable for the production of a body comprising lateral undercuts, in particular a rotationally symmetrical body, such as a wheel, without being limited thereto. The casting device is preferably configured such that the mold cavity, which is enclosed by the die parts, has a volume of at least 0.5 liters, in particular at least 3.0 liters, and/or maximally 50 liters. Depending on shape and size of the components to be produced, the mold cavity can also be designed as cavity nest, so that a plurality of components can be produced simultaneously with one casting process. The number of the used side die parts depends on the shape of the component, which is to be produced. For example two, three, four or more side die parts can be provided. For the production of a rotationally symmetrical body, the individual side die parts join to form a ring in the closed state. It is favorable thereby to provide for an even division of the individual segments, for example two half shells or three segments each comprising a 120° circumferential extension, or four segments each comprising a 90° circumferential extension.

In an example, the device has a mold end ring comprising a molding surface, which is tapered in the direction towards the first end portion, wherein the mold end ring is axially and radially supported against the base body. The mold end ring can be produced as separate component and be insertable into the base body. Alternatively or additionally, respectively, the mold end ring can also be fixedly connected to the base body, in particular by means of screw connections or can be designed integrally therewith. According to a further option, the mold end ring can also be fixedly connected to the first die part, in particular formed integrally therewith. In any case, the mold end ring is supported axially and radially against the base body, namely indirectly, when the mold end ring is assigned to the first die part, or directly, when the mold end ring is assigned to the base body.

The side die parts can comprise outer contact surfaces, which interact with the tapered inner surface of the base body, in particular such that upon an axial inserting movement into the base body the side die parts are moved radially inwardly towards one another and plunge axially into the mold end ring. The axial inserting movement defines a closing direction for closing the die parts, which in the completely closed state form the mold cavity for the component to be cast. The shape of the outer contact surfaces of the side die parts is designed so as to correspond to the inner surface of the base body, which is tapered in the closing direction. The outer contact surfaces of the side die parts and the inner surface of the base body, as well as the inner surface of the mold end ring can be designed in particular in a conical, cone segment-like or wedge-like manner.

Upon an axial inserting movement, the radial gaps formed between the respective side die parts close gradually, until the side die parts are finally supported against one another in the circumferential direction, and form a closed, i.e., a gap-free, die ring, and the lower annular edge of the die ring sealingly abuts on the tapered molding surface of the mold end ring. In the so defined end position of the side die parts, the die ring formed by said parts is axially and radially supported against the inner surface of the mold end ring, which is tapered in the closing direction. In this position, the inner surface, which widens, in the opening direction, extends axially beyond the annular edge of the die ring in the direction of the opening, i.e., the die ring and the mold end ring axially overlap one another in the end position to some extent.

In the end position, preferably a gap is formed between the lower annular edge of the side die parts and an upper molding surface of the first die part, which gap forms a part of the mold cavity to be filled. Laterally, that is radially outside, the upper molding surface can be delimited by the tapering inner surface of the mold end ring, which accordingly forms a lateral molding surface section for the component to be cast, across the gap height. The inner molding surface of the die ring formed by the side die parts, and the molding surface section of the mold end ring, connect to one another axially and together form a side wall of the mold cavity for the component to be cast.

The side die parts, which can also be referred to as die segments or die slides, are in each case fastened to a carrier element, via which an axial movement is introduced. The carrier elements support the side die parts and can thus also be referred to as support elements. For a preferably even movement of the side die parts into the base body or out of it, and for a high positional accuracy, it is in particular provided that the carrier elements are jointly axially movable. Preferably, one carrier element is provided for each side die part, wherein the carrier elements are held so as to be radially displaceable with respect to a stationary holding plate.

To open the casting device after the casting process has taken place, the side die parts and the second die part are moved in the direction away from the base body. This preferably takes place by means of a common axial movement. In an example, an axially movable operating plate can be provided, to which the upper die part is connected, so that it is axially moved together with the operating plate.

In an example, one or more ramp assemblies can be provided, which are configured to transform an axial movement of the operating plate in the opening direction into a radial movement of the carrier elements away from one another and away from the longitudinal axis, respectively. For this purpose, the operating plate preferably has at least one operating ramp for each carrier element, which cooperates with a corresponding setting ramp of the respective carrier element. By axially moving the operating plate in the opening direction, the setting ramps of the carrier elements slide along the corresponding operating ramps, which are sloped towards the radial outside, and are loaded by same radially outwardly, so that the assigned carrier element and the side die part connected thereto, is moved radially to the outside.

Further disclosed is a method for producing a metallic component by means of a casting device, which can have one or a plurality of the above-mentioned embodiments. According to the method, it is provided that the side die parts are inserted in the direction of the base body in order to close the casting device, wherein the outer surfaces of the side die parts are guided along the tapered inner surface of the base body, so that the side die parts are radially inwardly moved towards one another, until the side die parts are supported against one another in the circumferential direction and form a die ring, and the lower annular edge of the die ring sealingly abuts on the tapered molding surface of the mold end ring.

By the method, the advantages, which have already been mentioned in connection with the device, can be achieved, so that in this regard reference is made to the above description. It is understood that all features mentioned regarding the device can be transferred to the method accordingly and apply to said method and, vice versa, that all method features can analogously be transferred to the device.

In an example, the method can comprise the following steps: pressure die casting a melt of a metal alloy into the casting device, wherein the melt is introduced with a casting pressure through an opening in the first die part into the mold cavity from outside the base body, wherein a holding pressure is exerted on the side die parts and the upper die part, which holding pressure is larger than the casting pressure; sensing a pressure signal, which represents the internal pressure in the mold cavity; stopping the pressure die casting or reducing the casting pressure, respectively, when a sudden pressure rise is sensed; and, after a predetermined time with reduced pressure has passed, applying pressure to the component solidifying from the melt, by moving the upper die part relative to the lower die part, wherein a molding pressure, which is larger than the casting pressure, is applied to the component.

By applying the molding pressure to the workpiece, a crystal growth is inhibited at least in the edge area of the component and/or the crystals, which are created, are continuously broken open to form smaller crystals. Overall, a fine structure with a high strength is created. This pressure application is made possible in that the second die part, with respect to the position defined for the casting process, can be loaded and moved even further in the direction towards the first die part after the mold cavity has been completely filled. This, in turn, requires that the second die part is held in the casting position in a completely contact-free and/or support-free manner with respect to the first die part.

SUMMARY OF THE DRAWINGS

Example embodiments will be described below by means of the description below referring to the drawing figures, which show.

DETAILED DESCRIPTION

Figure 1:
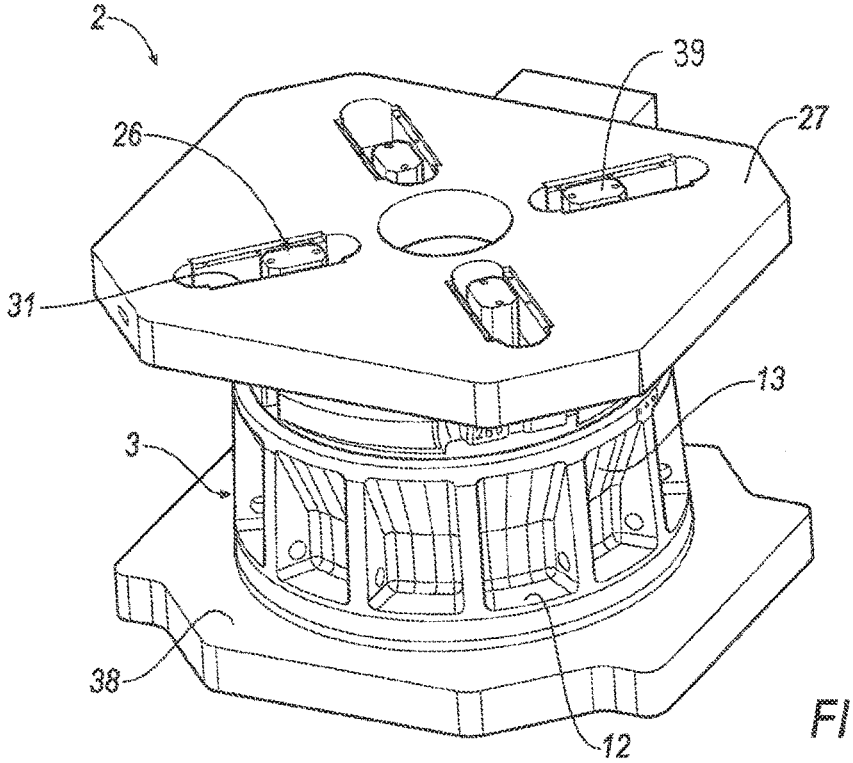
FIG. 1 shows an example device for casting a metallic component in the closed state in a perspective view.
Figure 2:
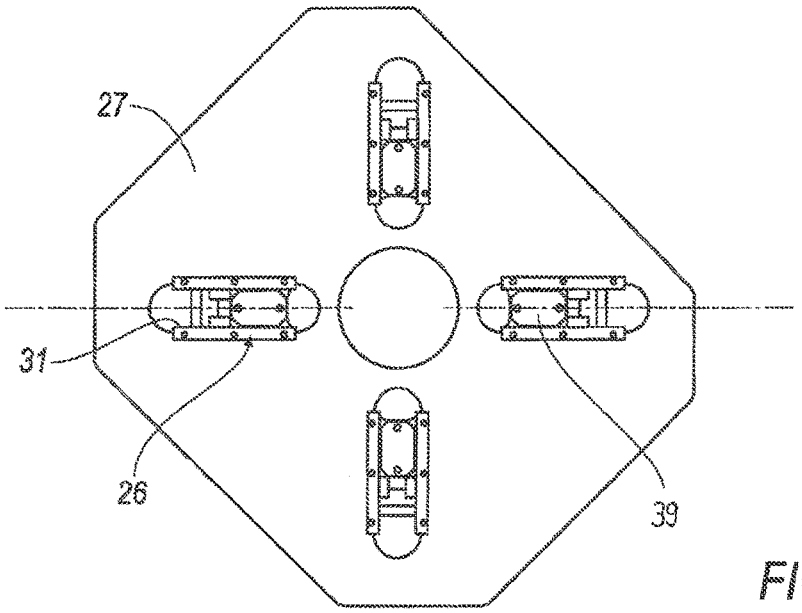
FIG. 2 shows the device of FIG. 1 in an axial view.

FIGS. 1 to 10 will be described together below. An exemplary device 2 for molding a component from a metal melt is shown.

The device 2, which can also be referred to as a casting and molding tool, comprises a base body 3, into which a first die part 4, a plurality of side die parts 5, and a further die part 6 are inserted. In the closed state, said die parts 4, 5, 6 together form a mold cavity 7 for the component 8, which is to be cast. The die parts can also be referred to as mold parts. The shape of the casting device 2 and of the individual die parts 4, 5, 6, respectively, is substantially determined by the shape of the cast component to be produced. All castable metals and metal alloys, respectively, can be used as casting materials which are correspondingly selected according to the technical demands on the component 8 to be produced. The mold cavity can have a volume of between 0.5 and 50 liters, for example.

In the present embodiment, the device 2 is configured for producing rotationally symmetrical bodies in the form of wheels, for which in particular metal alloys of light metal, such as aluminum, magnesium, titanium and/or further alloy components, can be used. The rotationally symmetrical component 8 to be produced comprises a circumferential undercut 11 between two rim edges 9, 10 arranged at opposite axial ends of the component.

In the present embodiment, the first die part 4 is arranged at the bottom, respectively is inserted into the base body 3 from the top, which is why it can also be referred to as bottom die part or lower die part. Accordingly, the second die part 6 is arranged above the first die part 4 and can thus also be referred to as upper die part. It is to be understood, however, that the arrangement could also be reversed, that is, the first die part could be at the top and the second die part at the bottom.

The base body 3 is designed in a cup-shaped manner and has an end portion 12, on which the first die part 4 is axially supported in a first direction, as well as a circumferential side wall 13, which extends away from the end portion. The end portion 12 forms a bottom comprising a central opening 14, in which the first die part 4 sits with a connecting section so as to form a seal. The first die part 4 has a central opening 15, through which the metal melt can be pressed into the mold cavity 7 from below the lower die part 4 with hydraulic pressure. The base body 3 can be fastened to a stationary carrier plate 38 that can also be referred to as support plate.

Figure 3:
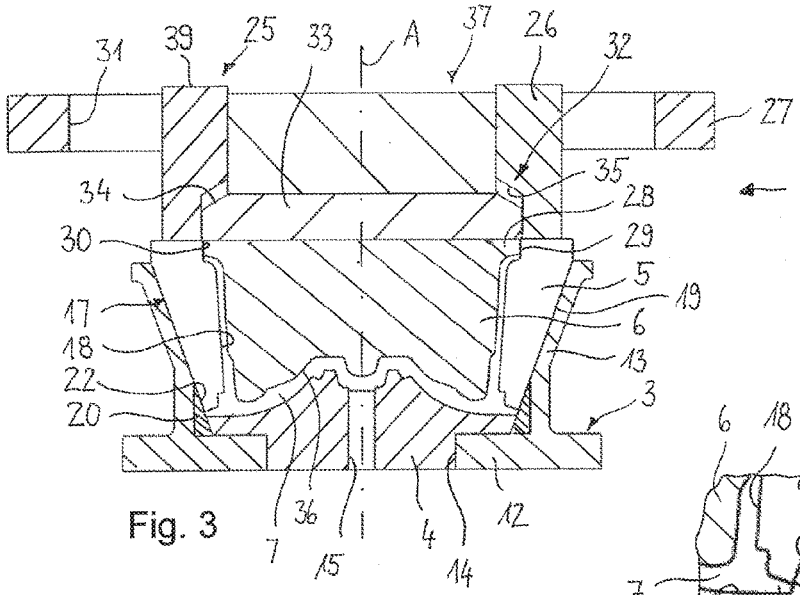
FIG. 3 shows the device of FIG. 1 for casting a metallic component in the longitudinal section in the closed state.

Starting at the end portion 12, the side wall 13 has an inner surface 16, which widens in the direction towards the free end of the side wall 13 and which is formed conically in the present embodiment. In the inserted state, as shown in FIG. 3, the side die parts 5 are axially and radially supported against the circumferential side wall 13 of the base body 3 and form a circumferentially closed die ring 17 comprising an inner molding surface 18 for the component to be cast. Insofar, the die ring can also be referred to as mold ring. In the present case, the number of the side die parts 5 is four, whereby it is understood that a different number, such as two, three or more than four can be used as well. The division of the individual side die parts 5 is made at regular intervals, that is, four segments are provided, which each extend approximately across one-fourth of the total circumference.

The side die parts 5 have outer contact surfaces 19, which are designed so as to correspond to the tapered inner surface 16 of the base body 3 and which cooperate therewith in a ramp-like manner. In the present embodiment, the inner surface 16 and the corresponding outer surfaces 19 are designed conically or cone segment-like, respectively, so that the side die parts 5 when being axially inserted into the case body 3 move radially inwardly towards one another, that is, in the direction towards the longitudinal axis A. The die parts 5 thereby increasingly approach one another, until they finally come to rest against one another in the circumferential direction and form a closed, i. e., a gap-free, outer die ring 17, as can be seen in particular in FIGS. 8 and 9. Due to the inner-conical guide surface 16 of the base body 3, a further axial insertion of the die ring 17 into the base body 3 is not possible, so that an end position, respectively a closed position, is defined. In this closed position, the die ring 17 is supported axially and radially against the base body 3.

Figure 4:
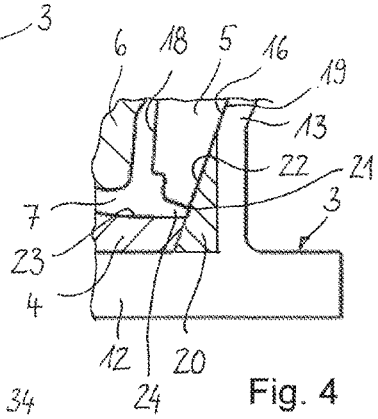
FIG. 4 shows a detail of the device from FIG. 3 in enlarged illustration.

As can be seen in particular in FIG. 4, a mold end ring 20 is provided in an end region of the component 8 to be cast, which end ring has a molding surface 22 that is tapered in the direction towards the bottom 12 of the base body 3. In the present embodiment, the mold end ring 20 is inserted into the base body 3 and is attached thereto. The connection can be realized in a force locking manner, for example by a press-fit, in a form-locking manner, for example by screws, and/or in a materially connecting manner, for example by welding. The tapered molding surface 22 of the mold end ring 20 and the inner surface 16 of the side wall 13 form a common inner guide surface for the side die parts 5 to be inserted. From a geometrical and functional view, the mold end ring 20 is thus an integral part of the base body 3, wherein the molding surface 22 of the mold end ring 20 forms a part of the inner surface 16 of the side wall 13. In the inserted condition of the side die parts 5, the casting mold is closed securely with a small clearance. At the same time, the cone surface 19 of the die ring 17 interacts with the counter cone 16 of the base body 3 and the mold end ring 20, respectively, so as to effect a good centering of the mentioned components relative to one another. The axial height of the mold end ring 20 is selected such that, in the closed position, the lower annular edge 21 of the side die parts 5 is arranged inside the mold end ring 20 and sealingly contacts the inner surface 22 thereof.

To that extent, the surface mating between the tapered outer surfaces 19 of the side die parts 5 on the one side, and the inner surface 16 of the base body 3, respectively the inner surface 22 of the mold end ring 20 on the other side, fulfill a double function, namely that a statically determined sealing stop is formed. Thus, a heat expansion of the die parts 4, 5 that occurs during casting is compensated for by automatic axial fine positioning of the side die parts 5, wherein the side die parts 5 are self-centered with respect to the first die part 4. There is no separate axial end stop for the side die parts, so that a static overdeterminacy is avoided.

An annular gap 24 is formed between the annular edge 21 of the side die parts 5 and the molding surface 23 of the first die part 4, which gap forms the part of the mold cavity 7 that is to be cast for the rim edge 9. The radially outer end of the molding surface 23 of the first die part 4 is laterally delimited by the tapering inner surface 22 of the mold end ring 20 that here forms a lateral molding surface section for the component 8 to be cast. The inner molding surface 18 of the die ring 17 formed by the side die parts 5, and the molding surface section of the mold end ring 20, axially connect to one another and together form an outer side wall of the mold cavity for the component to be cast.

An inner side wall of the mold cavity is formed by the second die part 6 that is inserted into the base body 3 prior to the casting and brought into a casting position. This is carried out by a correspondingly suitable operating device 37. In the present embodiment, a main inserting movement of the central die part 6 takes place together with the side die parts 5. For this, said die parts 5, 6 are jointly moved in the direction of the base body 3, until the side die parts 5 have reached their end position, in which they are radially and axially supported against the base body 3 and against the mold end ring 20, respectively. In this end position of the side die parts 5, the second die part 6 can be moved even further relative to the side die parts 5 and the first die part 4, respectively, in order to adjust the mold cavity to the desired dimension. For this purpose, the second die part 6 is moved axially relative to the first die part 4, until the required casting position is reached. It is provided that in the casting position, the second die part 6 is arranged in a completely contact-free manner relative to the first die part 4. On its end portion 28 delimiting the mold cavity 7, the upper die part 6 comprises a circumferential outer surface 29 that forms a seal together with a corresponding circumferential inner surface 30 of the die ring 17. In casting position, the two sealing surfaces 29, 30 have an axial overlap, so that a precise axial adjustment of the casting position is possible by corresponding axial movement of the upper die part 6, without hereby affecting the sealing function.

The relative movement between the second die part 6 and the first die part 4 is carried out by an operating device 37, which effects the main inserting movement as well as the accurate positioning of the upper die part into the casting position. The operating device 37 is furthermore suitable to move the second die part 6 in the direction towards the base body 3 and towards the first die part 4, beyond the casting position, in order to apply pressure to the component after the casting during the solidification. The operating device 37 is configured to realize different operating functions, namely to effect the axial displacement of the second die part 6 as well as of the side die parts 5 in the axial direction, i. e. towards the base body 3 (closing direction) and away therefrom (opening direction), as well as a displacement movement of the side die parts 5 in the radial direction, i. e. in the direction towards the longitudinal axis A (closing direction) and away therefrom (opening direction).

For each side die part 5, a respective carrier element 26 is provided to transfer a force to the respective side die part 5 and to move same, respectively. The carrier elements 26 are in each case fastened to an end portion of the side die parts 5, in particular to a front side of the side die parts 5. The fastening can be effected by screws, for example, without being limited thereto. It can be seen in FIGS. 8 and 9 that in the present embodiment four side die parts 5 and correspondingly four carrier elements 26 are provided. The carrier elements 26 engage with their connecting sections 39 through openings 31 of a stationary holding plate 27. The openings 31 are designed as elongated holes, so that the carrier elements 26 can be moved radially with respect to the stationary holding plate.

The carrier elements 26 can be force-loaded and moved by a respective power unit 25, wherein the power unit 25 acts upon and/or engages a connecting section 39 of the respective carrier element 26. To introduce power evenly into the side die parts 5, the power units 25 act simultaneously on the carrier elements 26. The power units 25 in particular take over the function of holding the side die parts 5 in the closed position in the inserted state, when pressure is introduced into the solidifying component via the operating device 37. The power units 25 can thus also be referred to as holding devices.

For each side die part 5, a ramp assembly 32 is provided, which is configured to effect an axial movement of the operating plate 33 in the opening direction R2 into a radial movement of the carrier elements 26 in the direction away from the longitudinal axis A. For each carrier element 26, the operating plate 33 thus has two operating ramps 34, which cooperate with a corresponding setting ramp 35 of the carrier element 26. When the operating plate 33 is axially moved in the opening direction R2, the setting ramps 35 of the carrier elements 26 slide along the corresponding operating ramps 34 that are inclined radially outwardly. The operating ramps 34 thereby act on the carrier elements 26 radially to the outside, so that the respective carrier element 26 and the side die part 5 connected thereto, are moved radially outwardly.

A casting cycle will be described below with respect to FIGS. 3 to 7. FIG. 3 shows the casting device 2 in the closed state, that is, the side die parts 5 are inserted into the casting body 3 and into the mold end ring 20, respectively, up to the end position and the upper die part 6 is adjusted to the casting position, so that the desired mold cavity 7 is at hand. The casting of the melt takes place from below through the opening 15 into the mold cavity 7 by a suitable device (not illustrated). The melt can be pressed in by means of a hydraulic pressure of more than 100 bar, in particular more than 150 bar. The metallic melt is preferably pressed into the mold cavity 7 in a semi-solid state, that is, by a temperature of below the liquidus line of the melt.

During the pressure filling, a counter pressure (holding pressure), which is larger than the casting pressure, is applied to the side die parts 5 and the upper die part 4. The counter pressure for the side die parts 5 can be introduced by means of the power units 25. The counter pressure for the upper die part 4 can be effected by the net weight thereof or via the central operating unit 37.

Pressure sensors (not illustrated) can be provided, which sense a pressure signal representing the hydraulic pressure in the mold cavity. By the pressure die casting, the melt gradually fills the mold cavity 7, until it is completely filled. On reaching the completely filled state, the hydraulic pressure rises suddenly, i. e., a measurable hydraulic pressure peak is generated. The casting process is controlled preferably in such a way that the casting pressure exerted on the melt is initially reduced for a defined time, for example for a time period of between one and ten seconds, when sensing such a pressure peak. During this time, the melt solidifies at least partially, in particular in the area of the rim edges 9, 10. The pressure is then increased again, namely to a molding pressure, which is larger than the casting pressure and which can be more than 500 bar, for example. The molding pressure is introduced into the workpiece via the second die part 4.

After the compete solidification of the workpiece, the casting device 2 is opened again. This takes place in several partial steps, as described below.

Figure 5:
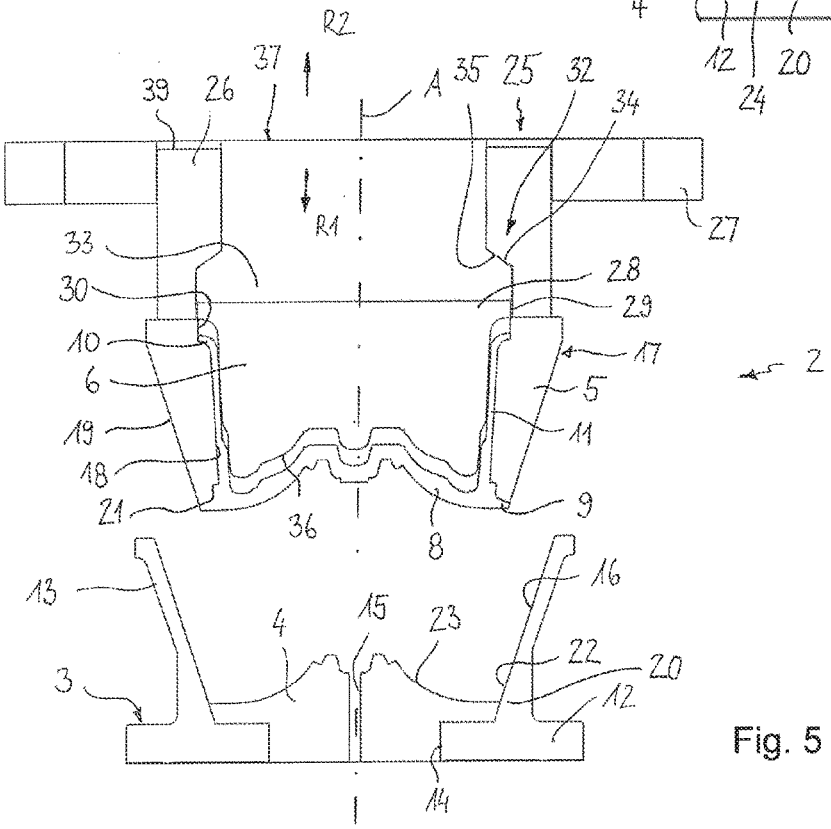
FIG. 5 shows the device of FIG. 1 in axially displaced position between upper unit and lower unit in a longitudinal section.

As shown in FIG. 5, the upper die part 6 and the side die parts 5 are initially retracted axially out of the lower die part 4 and the base body 3, respectively. This first retracting takes place as pure axial movement in the direction R2. In the present case, the device 2 is designed such that the upper die part 6 and the side die parts 5 are moved relative to lower die part 4 and base body 3. It is understood, however, that a reverse kinematics is also possible, that is, that upper part and lateral parts are held in a stationary manner and the base body is moved jointly with the lower part accommodated therein. The axially pulled-out position is shown in FIG. 5.

Figure 6:
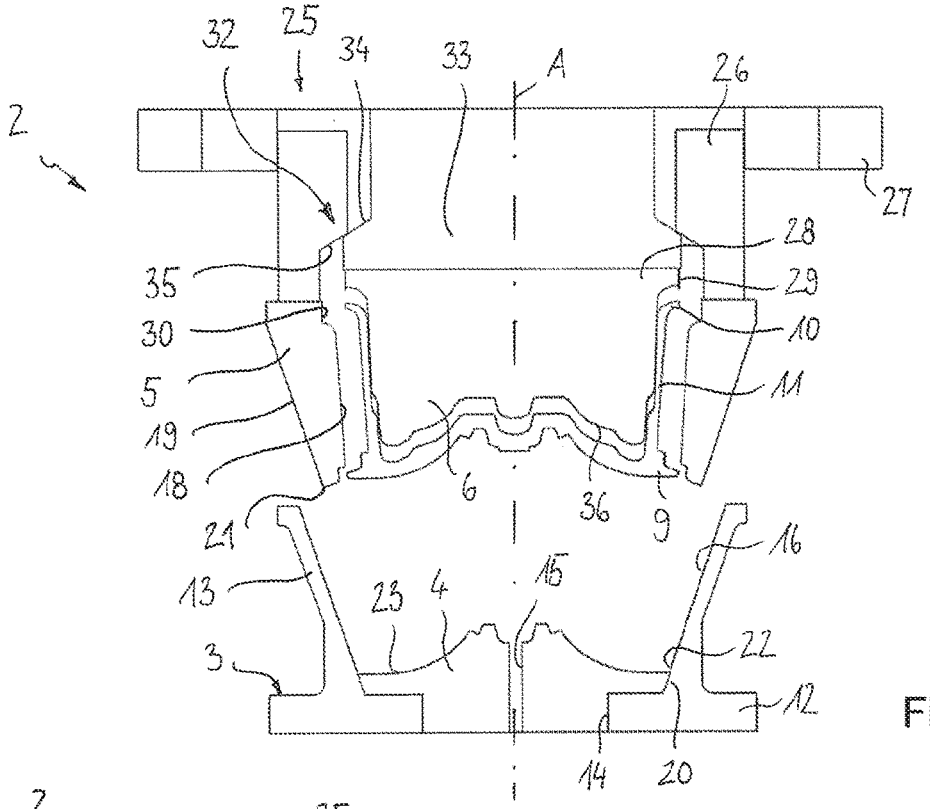
FIG. 6 shows the device of FIG. 1 in axially displaced position between upper unit and lower unit and partially laterally open position of the side die parts in a longitudinal section.

In the next step, the side die parts 5 are opened, that is, are moved radially outwardly. This takes place by means of the ramp assemblies 32, as described above, in that the carrier elements 26 slide with their setting ramps 35 along the respective operating ramps 34 of the operating plate 33, wherein a further axial movement of the operating plate 33 is transformed into a radial movement of the side die parts 5 away from the longitudinal axis A. The ramp assemblies 32 are dimensioned and/or configured such that the radial movement effected thereby is larger than the depth of the undercut 11 of the component 8 to be produced. FIG. 6 shows a radially open position of the side die parts 5, in which the operating plate 33, with the upper die part 6 fastened thereto, is moved axially upwards relative to the side die parts 5, so that the latter are pushed radially to the outside.

Figure 7:
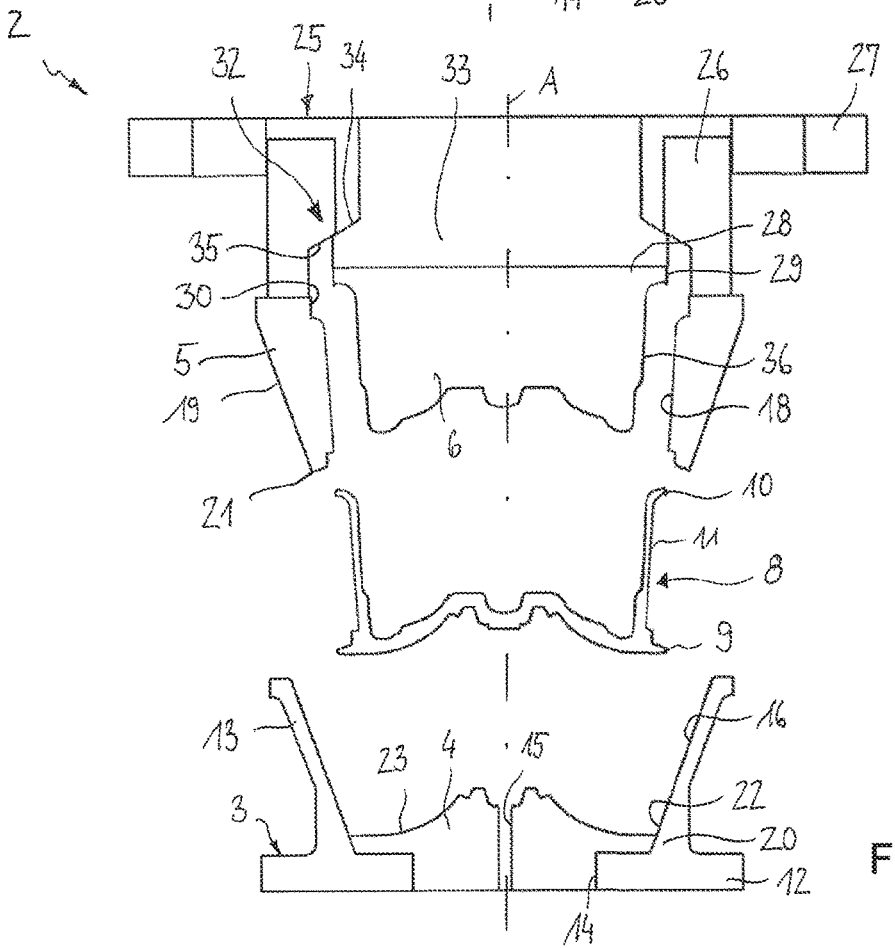
FIG. 7 shows the device of FIG. 1 in the completely open state in a longitudinal section.
Figure 8:
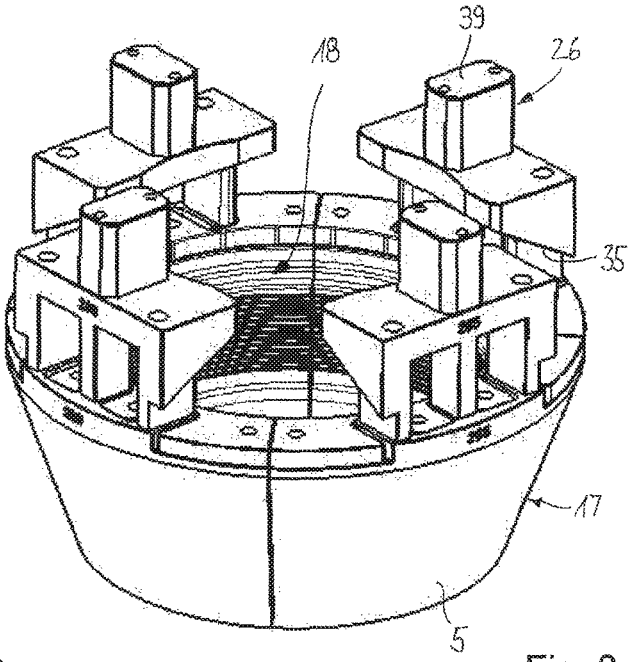
FIG. 8 shows the side die parts of the device shown in FIGS. 1 to 7 as a detail in the closed state in a perspective view.

Subsequently, the upper unit and the lower unit are moved axially further apart, so that the component 8, which is produced, can be removed. This completely open position is shown in FIG. 7.

Figure 10:
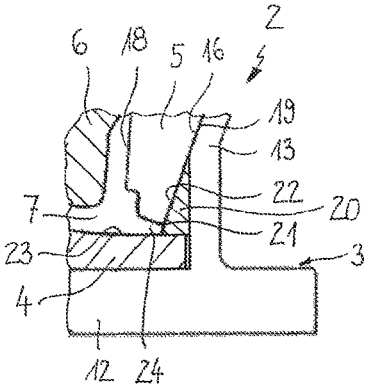
FIG. 10 shows a detail of a device for casting a metallic component according to a further embodiment.
Figure 9:
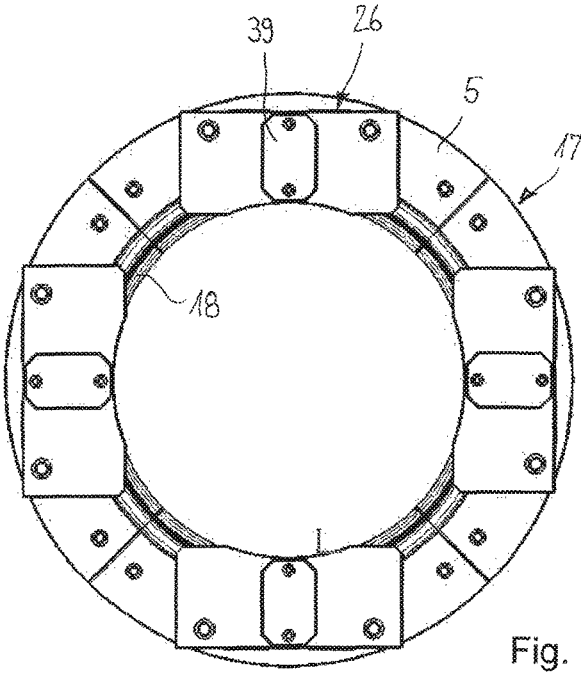
FIG. 9 shows the side die parts of FIG. 8 in an axial view.

FIG. 10 shows a detail of a device 2 for casting a metallic component in a slightly modified embodiment. The device 2 according to FIG. 10 substantially corresponds to the device according to FIGS. 1 to 9, to the description of which reference is made in this respect. Identical details are thereby provided with identical reference numerals, as in the embodiment according to FIGS. 1 to 9.

The only difference lies in the configuration of the first die part 4 and of the mold end ring 20, which will be described below. In the embodiment according to FIG. 10, the first die ring 4 extends radially to the outside beyond the inner surface 22 of the mold end ring 20. The mold end ring 20 is connected to the base body 3 and is supported, respectively braced, against the first die ring 4 at least in the axial direction. This can be effected by means of screws, for example, which are inserted into the bottom section 12 from below, are guided through corresponding through-openings in the first die part 4 and are screwed into the mold end ring 20 from below. The mold end ring 20 is thus fixedly braced against the upper side of the first die part 4, so that a gap formed between these parts is minimal. A radial gap is preferably provided radially outside between a circumferential outer surface of the first die part 4 and an inner surface of the base body 3, so that heat expansions of the die part 4 can be compensated.

The described device 2 and method, respectively, always enable a secured closing of the casting mold. The tapering contact surfaces of the lateral parts 5 on one side, and the base body 3 and the mold end ring 20 on the other contribute to this; said contact surfaces can be designed as cone and counter cone for a rotationally symmetrical component. A static overdeterminacy of the system is avoided. Different temperature gradients, which appear in the individual die parts upon casting, have at best only a small impact on the reliable closing of the casting mold. The clearances and the wear are thus small and the production accuracy is correspondingly high. Workpieces comprising an undercut can be produced in a near-net-shape. When using a high pressure-supported casting method, no extensive mechanical locking mechanisms, such as for example a toggle lever mechanism, are required. In fact, the locking can take place solely by correspondingly applying axial pressure to the side die parts 5 and to the upper die part 6, for example by means of hydraulic presses. Due to the stop-free design of the second die part 6 relative to the first die part 4, pressure can still be applied to the component 8 after the casting and after at least partial solidification.

LIST OF REFERENCE NUMERALS

2 device
3 base body
4 first die part
5 side die part
6 second die part
7 mold cavity
8 component
9 rim edge
10 rim edge
11 undercut
12 end portion
13 side wall
14 opening
15 opening
16 inner surface
17 die ring
18 molding surface (5)
19 contact surfaces
20 mold end ring
21 annular edge
22 molding surface (20)
23 molding surface (4)
24 annular gap
25 power unit
26 carrier element
27 holding plate
28 end portion
29 outer surface
30 inner surface
31 opening
32 ramp assembly
33 operating plate
34 operating ramps
35 setting ramps
36 molding surface (6)
37 operating unit
38 carrier plate
A axis
R direction

The invention claimed is:

1. A device for casting a metallic component, comprising:

a base body including a first end portion and a circumferential side wall, wherein the side wall has an inner surface that is tapered in a direction towards the first end portion;

a first die part that is insertable into the base body and that forms a first molding surface;

a plurality of side die parts that are insertable into the base body, wherein the side die parts are radially supported against the circumferential side wall of the base body in an inserted state, and form a die ring comprising an inner molding surface;

a second die part which is movable into the die ring formed by the side die parts up to a casting position for casting, and which forms a second molding surface, wherein, in the inserted state, the second die part is axially movable relative to the side die parts, and is arranged in a contact-free manner with respect to the first die part in the casting position.

2. The device according to claim 1, further comprising an operating device for moving the second die part in the axial direction, wherein the second die part is movable beyond the casting position in a direction towards the first die part to apply pressure to the component to be cast.

3. The device according to claim 1, further comprising a mold end ring including a molding surface that is tapered in a direction towards the first end portion, wherein the mold end ring is attached to the base body.

4. The device according to claim 1, wherein the side die parts have outer contact surfaces that interact with the tapered inner surface of the base body such that the side die parts are moved radially inside towards one another upon an axial inserting movement into the base body.

5. The device according to claim 3, wherein the mold end ring is firmly connected to one of the base body and the first die part.

6. The device according to claim 3, wherein the inner molding surface of the die ring formed by the side die parts, and a partial section of the tapering molding surface of the mold end ring, connect to one another axially and together form a side wall of the mold cavity.

7. The device according to claim 1, wherein, in the inserted state of the side die parts, a gap is formed between the lower annular edge of the side die parts and the molding surface of the first die part, which gap forms a part of the mold cavity to be filled.

8. The device according to claim 1, wherein the side die parts are each fastened to a respective carrier element, wherein the carrier elements are jointly axially movable for inserting the side die parts into the base body.

9. The device according to claim 1, wherein at least one pressure application unit is provided for applying pressure axially to the side die parts in the inserted state.

10. The device according to claim 8, wherein at least two side die parts and carrier elements are provided, wherein the carrier elements are held in a radially displaceable manner with respect to a holding plate.

11. The device according to claim 10, wherein at least one ramp assembly is provided, which is configured to translate an axial movement in the opening direction into a radial movement of the carrier elements away from one another.

12. The device according to claim 11, wherein at least one axially displaceable operating member is provided, wherein the ramp assembly comprises at least one operating ramp that is assigned to the operating member, and at least one corresponding setting ramp that is assigned to a respective one of the carrier elements, wherein upon axial movement of the operating member in the opening direction the at least one setting ramp slides along the corresponding operating ramp, wherein for each carrier element a respective ramp assembly is provided, wherein the axially displaceable operating member comprises all operating ramps, so that all carrier elements are jointly movable upon axial movement of the operating member.

13. The device according to claim 1, wherein the mold cavity, which is enclosed by the first die part, the side die parts and the second die part, has a volume of at least 0.5 liters.

14. A method for producing a metallic component by a casting device comprising:

a base body including a first end portion and a circumferential side wall, wherein the side wall has an inner surface that is tapered in a direction towards the first end portion;

a first die part that is insertable into the base body and that forms a first molding surface;

a plurality of side die parts that are insertable into the base body, wherein the side die parts are radially supported against the circumferential side wall of the base body in an inserted state, and form a die ring comprising an inner molding surface;

a second die part which is movable into the die ring formed by the side die parts up to a casting position for casting, and which forms a second molding surface, wherein, in the inserted state, the second die part is axially movable relative to the side die parts, and is arranged in a contact-free manner with respect to the first die part in the casting position;

the method comprising axially inserting the side die parts in a direction of the base body, wherein the outer surfaces of the side die parts are guided along the tapered inner surface of the base body, so that the side die parts are moved radially inside towards one another, until the side die parts are supported against one another in a circumferential direction and form the die ring, and the lower annular edge of the die ring sealingly abuts on the tapered molding surface of the mold end ring.

15. The method according to claim 14, further comprising:

die casting a melt of a metal alloy into the casting device, wherein the melt is introduced through an opening in the first die part into the mold cavity from below at a casting pressure, wherein a holding pressure is exerted on the side die parts and the second die part, which pressure is larger than the casting pressure;

sensing a pressure signal, which represents the internal pressure in the mold cavity;

reducing the casting pressure, when a sudden pressure rise is sensed;

after a predetermined time with reduced pressure has passed, applying pressure to the component, which solidifies from the melt, by moving the second die part relative to the first die part, wherein a molding pressure, which is larger than the casting pressure, is applied to the component.

* * * * *